US008588031B2

(12) United States Patent
Goeller

(10) Patent No.: US 8,588,031 B2
(45) Date of Patent: Nov. 19, 2013

(54) TIMEPIECE MOVEMENT COMPRISING A RUNNING EQUATION OF TIME DEVICE

(75) Inventor: Eric Goeller, Les Hopitaux Neufs (FR)

(73) Assignee: Montres Breguet SA, L'Abbaya (CH)

( * ) Notice: Subject to any disclaimer, the term of this patent is extended or adjusted under 35 U.S.C. 154(b) by 88 days.

(21) Appl. No.: 13/424,528

(22) Filed: Mar. 20, 2012

(65) Prior Publication Data

US 2012/0243380 A1 Sep. 27, 2012

(30) Foreign Application Priority Data

Mar. 23, 2011 (EP) ..... 11159387

(51) Int. Cl.
*G04B 19/26* (2006.01)

(52) U.S. Cl.
USPC ..... 368/17; 368/34

(58) Field of Classification Search
USPC ..... 368/15–20, 28, 34–36, 220–222
See application file for complete search history.

(56) References Cited

U.S. PATENT DOCUMENTS

| | | | | |
|---|---|---|---|---|
| 5,184,333 | A * | 2/1993 | Caspar | 368/28 |
| 6,826,122 | B2 * | 11/2004 | Zaugg | 368/28 |
| 7,372,781 | B2 * | 5/2008 | Loth | 368/223 |

FOREIGN PATENT DOCUMENTS

| | | | |
|---|---|---|---|
| CH | 689 359 | A5 | 3/1999 |
| CH | 698 613 | B1 | 9/2009 |
| EP | 0 509 959 | A1 | 10/1992 |
| EP | 0 509 959 | B1 | 10/1992 |
| EP | 1 286 233 | A1 | 2/2003 |
| EP | 1 286 233 | B1 | 2/2003 |

OTHER PUBLICATIONS

European Search Report issued Oct. 14, 2011, in European Patent Application No. 11159387.7, filed Mar. 23, 2011, (with English Translation).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

The timepiece movement comprises a running equation of time device having a pipe (113) provided to support a minute hand for solar time mounted concentrically to the minute and hour hands for civil time, an equation of time cam (101) rotatably driven by the movement at the rate of one revolution per year, and a correction mechanism provided to periodically adjust the angular displacement of the minute hand for solar time in relation to the minute hand for civil time as a function of the angular position of the equation of time cam.

9 Claims, 5 Drawing Sheets

TIMEPIECE MOVEMENT COMPRISING A RUNNING EQUATION OF TIME DEVICE

This application claims priority from European Patent Application No. 11159387.7 filed 23.03.2011, the entire disclosure of which is incorporated herein by reference.

FIELD OF THE INVENTION

The present invention relates to a movement for a complication timepiece provided to rotatably drive an hour hand and a minute hand for civil time and comprising a running equation of time device provided to drive a minute hand for solar time to rotate coaxially to the minute and hour hand for civil time.

As is known, there is difference between true solar time, which corresponds to the passage of time between two consecutive higher passages of the sun across the meridian in the same location, and civil time, which is the mean formed over the year of the duration of all true solar days. This difference between civil time and true solar time reaches +14 min. 22 s. on 11 February, −16 min. 23 s. on 4 November and is cancelled out on 15 April, 13 June, 1 September and 25 December. These values vary little from year to year.

PRIOR ART

To show the difference between civil time and solar time some timepieces comprise a so-called running equation of time device, i.e. one in which the hand assembly comprises two concentric minute hands, one indicating civil time and the other solar time, and the minute hand for solar time is controlled by an equation of time cam, the profile of which is determined by the difference between mean solar time and true time at a given instant.

Patent document CH 689,359 in particular describes a timepiece movement comprising such a running equation of time device. According to this document, the device comprises an equation of time cam rotatably driven by the movement at the rate of one revolution per year. This cam cooperates with one end of a lever, while the other end of the lever extends in the direction of the axis of rotation of the hands. Thus, while turning, the equation of time cam causes the lever to pivot and this pivoting movement causes the distance between the free end of the lever and the axis of the hands to vary. The end of the lever facing the hands is provided with a slope arranged to act as cam sector to set the minute hand for solar time once a day.

The running equation of time device also comprises a pipe fitted with a pinion and provided to support the minute hand for solar time. This pipe is rotatably mounted concentrically to the minute and hour hands for civil time. The correction mechanism for the running equation of time also comprises a support that is rotationally fixed to the minute hand for civil time. A rack is pivoted on the support and the toothed sector of the rack is arranged to mesh with the pinion of the pipe supporting of the minute hand for solar time. On the opposite side of the toothed sector the stem of the rack comprises a positioning pin. It will be understood that the positioning pin turns around the axis of the hands with the support. Thus, it turns at the speed of the minute hand for civil time. If the positioning pin encounters the slope of the equation of time lever during its movement, it slides against this. The reaction force exerted by the slope on the pin pushes the pin back in the direction of the axis of rotation of the hands. Thus, the pin is forced to deviate from its circular trajectory and this causes the rack to pivot. When it pivots, the rack entrains the pinion of the pipe with it and this causes the pipe to frictionally rotate and turn the minute hand for solar time, which thus shifts in clockwise direction. Since the rack is pivoted on the support, the rotation of the pipe occurs in relation to the support and therefore in relation to the minute hand for civil time. It will be understood from the above that it is the distance between the positioning pin and the axis of rotation of the hands at the instant the pin arrives at the end of the slope of the lever that determines the exact position of the minute hand for solar time.

The mechanism that has just been described only allows correction of the position of the minute hand for solar time in clockwise direction. This is why a second mechanism is provided to put back the hand. This second mechanism comprises releasing means provided to release the pipe of the minute hand for solar time. These releasing means are arranged to release the pipe when a force is applied to a control lever provided for this purpose, and to lock the pipe again when the force ceases to be applied. The second mechanism also comprises an actuating device, which is controlled by the movement to apply a force once every 24 hours to the control lever of the releasing means. In response to this force the releasing means release the minute wheel for solar time such that it becomes free to turn relative to the minute hand for civil time. It is pointed out that the engagement of the rack with the pinion of the pipe is not affected by this releasing action. The second mechanism additionally comprises a small spring mounted on the support and arranged to push the rack in order to pull the pinion and the pipe back in anticlockwise direction. Thus, when the pipe is released, the small spring causes the rack to pivot, thus moving the positioning pin away from the axis of rotation of the hands. The actuating device controlled by the movement is provided to actuate the releasing means at an instant when the positioning pin is located facing the start of the slope. Thus, at the moment the pipe is released, it turns in anticlockwise direction until the positioning pin is held back by the slope, against which it abuts.

It is thus understood that, with the running equation of time device just described, the correction of the position of the minute hand for solar time occurs once every 24 hours in two stages. In a first stage the minute hand for solar time turns in anticlockwise direction until it is in a position behind solar time. Then in a second stage the minute hand for solar time is brought back in clockwise direction to the position determined by the equation of time cam. This device has some inconveniences. On the one hand, the necessity of having a second mechanism to move the hand back complicates the structure considerably. On the other hand, the pipe of the minute hand for solar time has the ability at any time to frictionally rotate relative to the minute hand for civil time. This ability can prove problematic in the event of impact. In fact, an impact even of moderate intensity can be sufficient to alter the angular gap between the hands for civil time and for solar time. Finally, the force of the small spring must be too weak to cause the pipe to frictionally rotate and at the same time it must be sufficient to cause the pipe to turn when it is released. Therefore, the described arrangement involves some adjustment difficulties.

BRIEF OUTLINE OF THE INVENTION

Therefore, it is an aim of the present invention to remedy the disadvantages of the prior art that have just been described and in particular to correct the running equation of time in clockwise direction and in anticlockwise direction with the same mechanism. The present invention achieves this aim by providing a movement for a timepiece comprising a running equation of time device according to the attached claim 1.

According to the invention, the frame is connected kinematically to the equation of time cam. The angular position of the frame is therefore representative of the difference between civil time and solar time. Moreover, the frame supports the equation of time lever and this lever is returned against the periphery of the heart-piece. Thus, in a manner known per se, the force exerted by the lever on the heart-piece generates a moment that endeavours to rotate the heart-piece back towards an equilibrium angular position. Since the equation of time lever is mounted on the frame, the equilibrium angular position is linked to the angular position of the frame. The position of the heart-piece at equilibrium is therefore representative of the difference between civil time and solar time.

The heart-piece is secured to the pipe provided to support the minute hand for solar time. Therefore, the heart-piece is held by the pipe so long as no force is exerted on the control lever of the locking means. When a pressure is exerted on the control lever at a given instant, this pressure causes the pipe to be released and the pipe is then free to turn with the heart-piece. As shown above, the heart-piece and the pipe are then driven towards an equilibrium position representative of the difference existing between civil time and solar time. The heart-piece and the pipe then remain in the equilibrium position so long as the locking means are not closed again. Some moments later the pressure on the control lever ceases and the locking means lock the pipe once again. From this moment, the minute hand for solar time and the minute hand for civil time are held together and turn jointly at the rate of one revolution per hour.

It is also understood that when the locking means lock the pipe, the angular distance between the two minute hands is determined, on the one hand, by the time lag between civil time and solar time and, on the other hand, by the position the minute hand for civil time occupies at the precise instant the locking means have locked the pipe. Therefore, with this system the minute hand for civil time must occupy a very precise position at the instant of locking so that the angular distance between the two hands then properly corresponds to the time lag between civil time and solar time. Since the minute hand for civil time is provided to pass through the same position again exactly once an hour, the periodic adjustment of the angular gap between the minute hand for solar time and the minute hand for civil time must be made at a very precise moment and can only be made once an hour at maximum. In other words, the period separating two consecutive adjustments must correspond to an integer number of hours.

BRIEF DESCRIPTION OF THE FIGURES

Other features and advantages of the present invention will become evident upon reading the following description given solely by way of non-restrictive example and provided with reference to the attached drawings, wherein.

DETAILED DESCRIPTION OF AN EMBODIMENT

The timepiece movement of the present invention preferably comprises a perpetual calendar mechanism or other type of calendar mechanism with displays of the day of the month and of the month. However, it is to be noted that the present invention is not restricted to movements comprising a calendar.

The timepiece movement of the present example comprises a calendar mechanism. However, only the running equation of time mechanism, and not the timepiece movement in its entirety, will be described in the following. With respect to the calendar, all that needs to be clarified is that the display of the day of the month is performed in a known manner by means of a 31 wheel-set driven at a rate of one revolution per month and that by means of a geartrain with a gear ratio of 1/12 the 31 wheel-set itself drives an equation of time cam 101 provided to perform a full revolution in one year. In a known manner, the radius of the equation of time cam expresses the value of the difference between civil time and true solar time for a given day of the year at each point of its circumference.

Figure 1:
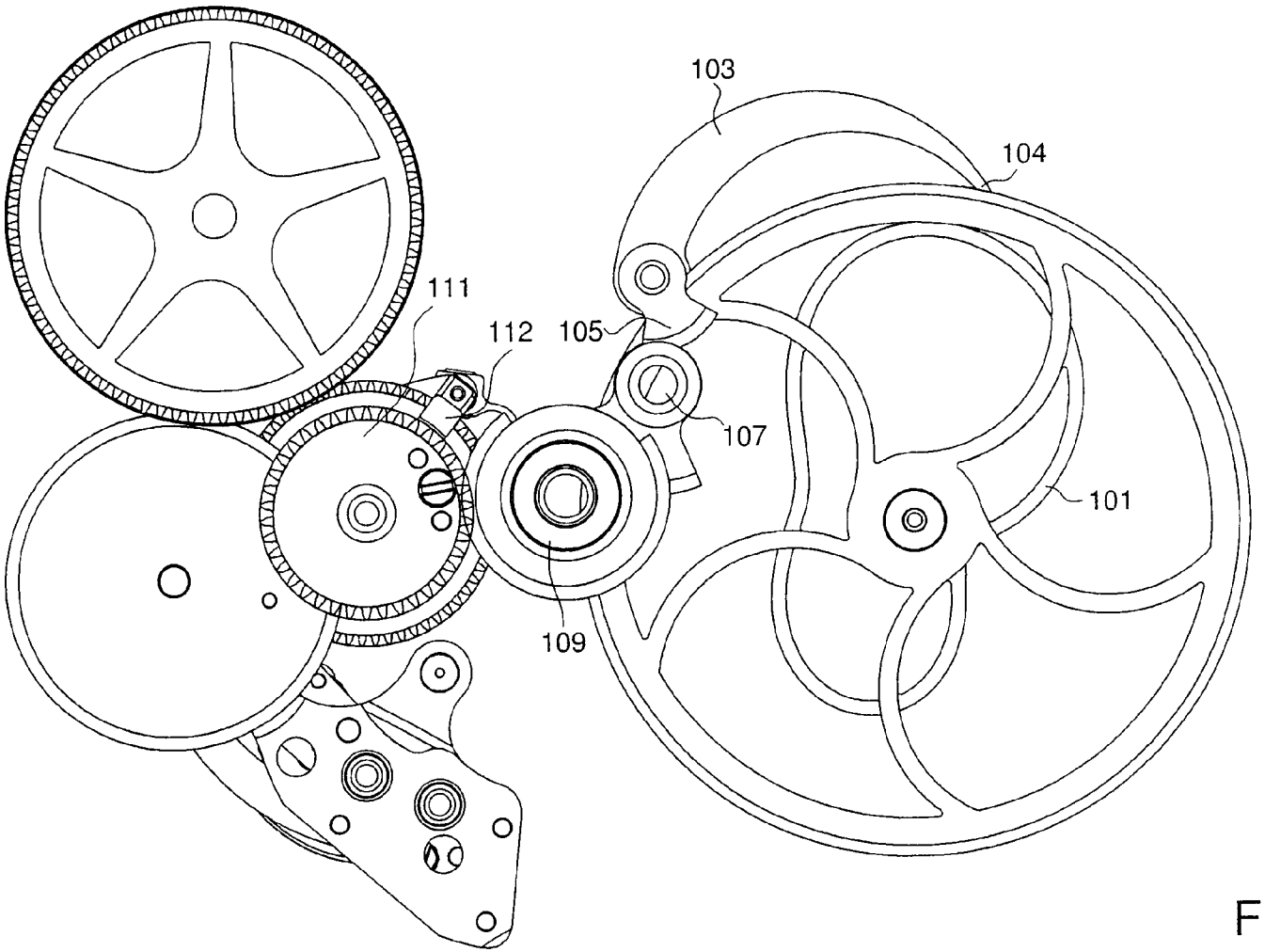
FIG. 1 is a schematic plan view (from the bridges side) of a sloticular embodiment of the running equation of time device of the movement for a complication timepiece of the present invention.

Firstly with reference to FIG. 1, it is evident that the running equation of time device also comprises a pivoted lever 103. This lever is subjected to a returning action of a spring (not shown) that endeavours to apply the profile tracer 104 forming the distal end of the lever against the periphery of the equation of time cam 101. The pivoted lever 103 is rotationally fixed to a first toothed sector 105, which constitutes the first element of a wheel train actuated by the equation of time cam 101. Besides the first toothed sector, the wheel train comprises a toothed wheel 111 mounted to pivot concentrically to the hand assembly of the movement as well as a first wheel-set 107 formed by a pinion and a toothed sector and a second wheel-set 109 also formed by a pinion and a toothed sector. The first and second wheel-sets are interposed between the first toothed sector and the toothed wheel 111. The first toothed sector 105 meshes with the pinion of the first wheel-set 107, the toothed sector of the first wheel-set meshes with the pinion of the second wheel-set 109 and finally the toothed sector of the second wheel-set meshes with the toothed wheel 111. The gear ratio of the wheel train is selected as a function of the dimensions of the equation of time cam 101 such that a variation of one minute in the equation of time is ultimately expressed by a rotation of 6° of the toothed wheel 111. It will therefore be understood in particular that the angular position of the wheel 111 is representative of the difference between civil time and solar time.

Figure 2:
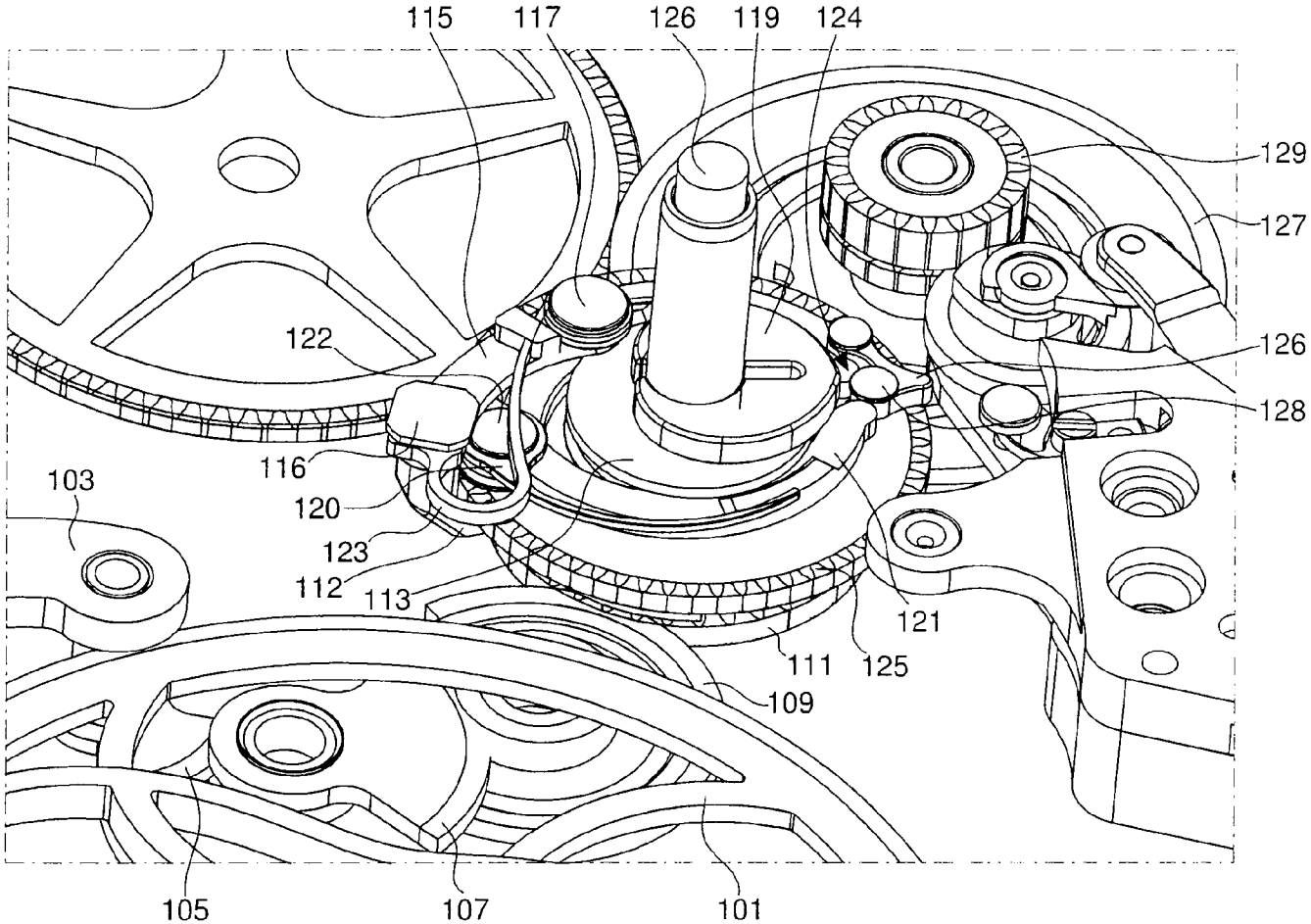
FIG. 2 is a partial perspective view of the running equation of time device of FIG. 1.
Figure 4:
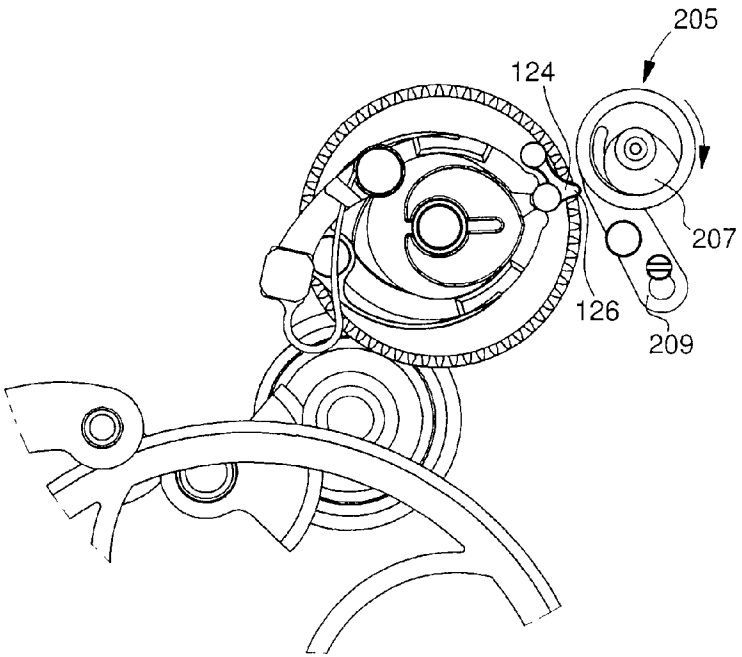
FIG. 4 is a schematic plan view (from the dial plate side) showing the actuating device of FIG. 3.
Figure 3:
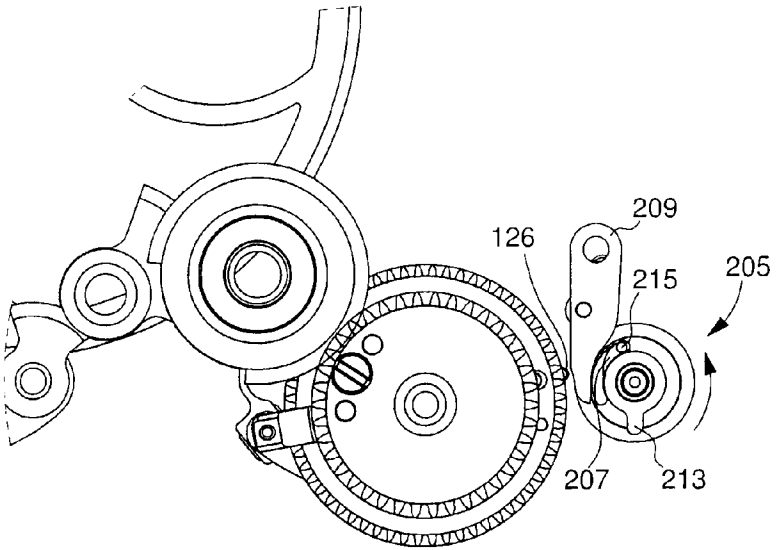
FIG. 3 is a schematic partial plan view showing the actuating device of the correction mechanism of the running equation of time device of FIGS. 1 and 2.

With reference now to FIG. 2, it can be seen from the figure that the movement also comprises a wheel-set 125 having an axis 126 supporting the minute hand for civil time (not shown). The wheel-set 125 will be referred to hereafter as "the false cannon-pinion". The running equation of time device also comprises a pipe 113 that is adjusted freely on the axis 126 and supports the minute hand for solar time (not shown). It can also be seen that a locking clamp 121 surrounds the pipe 113. This clamp is articulated on a pivot 122, which is fixed in eccentric position on the flanc of the false cannon-pinion 125. A double spring 120 presses the jaws of the locking clamp against the outside of the pipe 113. Finally, a small T-shaped lever 124 is pivoted at the level of the base of the T on the flanc of the false cannon pinion 125. The small lever 124 is arranged so that a force exerted on a first end 126 of the bar of the T causes the other end 128 to move between the jaws of the clamp 121 and to act as a wedge to hold them apart. It will be understood that when the jaws of the locking clamp 121 are closed, the pipe 113 is secured to the false cannon pinion 125, which drives it in rotation. Thus, the angle formed by the minute hand for solar time and the minute hand for civil time cannot be modified so long as no force is exerted on the end 126 of the small control lever 124.

The running equation of time device also comprises a heart-piece 119 that is driven onto the pipe 113 and an equation of time lever 115, the end of which is returned against the periphery of the heart-piece by a spring 123. Moreover, as can be seen in FIG. 1, a radial arm with the reference 112 is fastened to the toothed wheel 111. It is evident in FIG. 2 that the arm 112 firstly extends radially to beyond the teeth of the false cannon-pinion 125 to then curve upwards and terminate approximately facing the heart-piece 119. The end of the arm 112 forms a small off-centre support 116, and it will be understood that the function of the toothed wheel 111 with its arm 112 is that of a rotating frame. It is also evident in FIG. 2 that the small support 116 simultaneously acts as an anchorage point for the spring 123 and a pivoting point for the equation of time lever 115. It is finally evident that the equation of time lever 115 bears a roller 117 on its end and that this roller is pressed against the periphery of the heart-piece 119 by the spring 123. In a manner known per se, the force that the roller 117 exerts on the heart-piece comprises a tangential component that endeavours to bring the heart-piece in the direction of its stable equilibrium angular position, or in other words in the direction of the position in which the roller is located in the recess of the heart-piece.

The running equation of time device also comprises a actuating device driven by the movement that will be described in detail below.

The operation of the running equation of time device that forms the subject of the present example shall now be described. As has been seen, so long as no force is exerted on the control lever 124, the pipe 113 and the heart-piece 119 are fixed to the false cannon pinion 125 that rotatably drives them. As described previously, the actuating device is arranged to press against the end 126 of the small lever 124 once every 3 hours. The actuating device thus forces the jaws of the locking clamp 121 to part and release their pressure on the pipe 113. When released by the clamp the pipe pivots, driven by the heart-piece, until the roller 117 comes to rest in the recess of the heart-piece. It will be understood that the position the minute hand for solar time occupies at this precise moment depends on the angular position of the frame 111 and therefore on that of the equation of time cam 101. Some moments later, the actuating device ceases to press on the control lever 124 and the jaws of the clamp 121 close again on the pipe 113 setting the angle between the two minute hands for the next 3 hours. It is understood in this regard that the angle between the two minute hands at the instant the clamp 121 closes again on the pipe 113 is determined by the position the equation of time cam, on the one hand, and the position of the minute hand for civil time, on the other, occupy at this instant. The position the minute hand for civil time occupies at the instant the locking means close again is therefore critical for the operation of the running equation of time device of the present invention.

The actuating device of the running equation of time correction mechanism shall now be described with reference to FIGS. 3 to 7. As can be seen in the figures, the actuating device comprises a trailing wheel 205, a finger 213 (FIG. 3) mounted freely on the axis of the trailing wheel, a cam 207 (FIG. 4), which is also mounted freely on the axis of the trailing wheel, but on the opposite side in relation to the finger, a lever 217 bearing a small roller 219 (FIGS. 5 and 6), a spring (not shown) arranged to return the small roller of the lever against the periphery of the cam, and finally a tipper 209.

In the present example the trailing wheel 205 is driven by the motion work of the movement (not shown) at the substantially constant rate of one revolution every 3 hours. Therefore, the trailing wheel will be referred to hereafter as the "3-hour wheel". However, it will be understood that this wheel could be driven at a different rate. In fact, for the device to operate correctly it is sufficient that it performs precisely one revolution in N hours, wherein the parameter "N" can be any integer number higher than or equal to 1. It will also be understood that the kinematic chain that drives the trailing wheel does not necessarily pass through the motion work.

Figure 6:
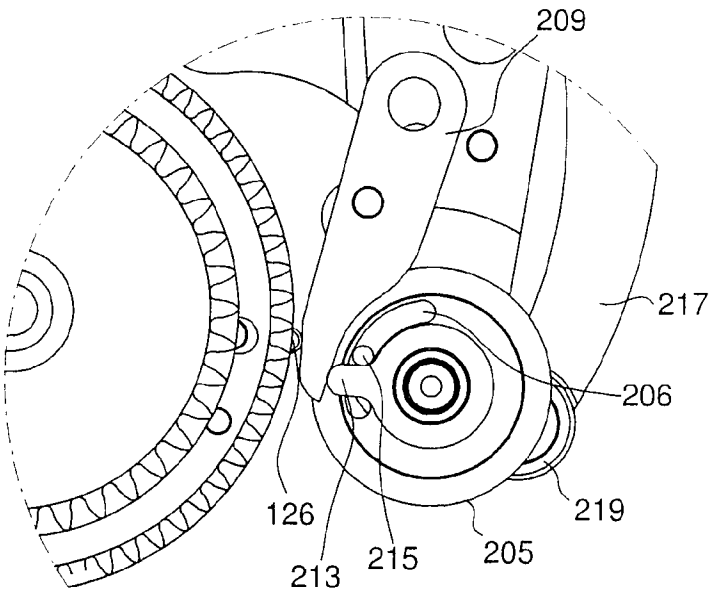
FIG. 6 is a partial view similar to that of FIG. 5 and showing the configuration of the actuating device during the jump.
Figure 7:
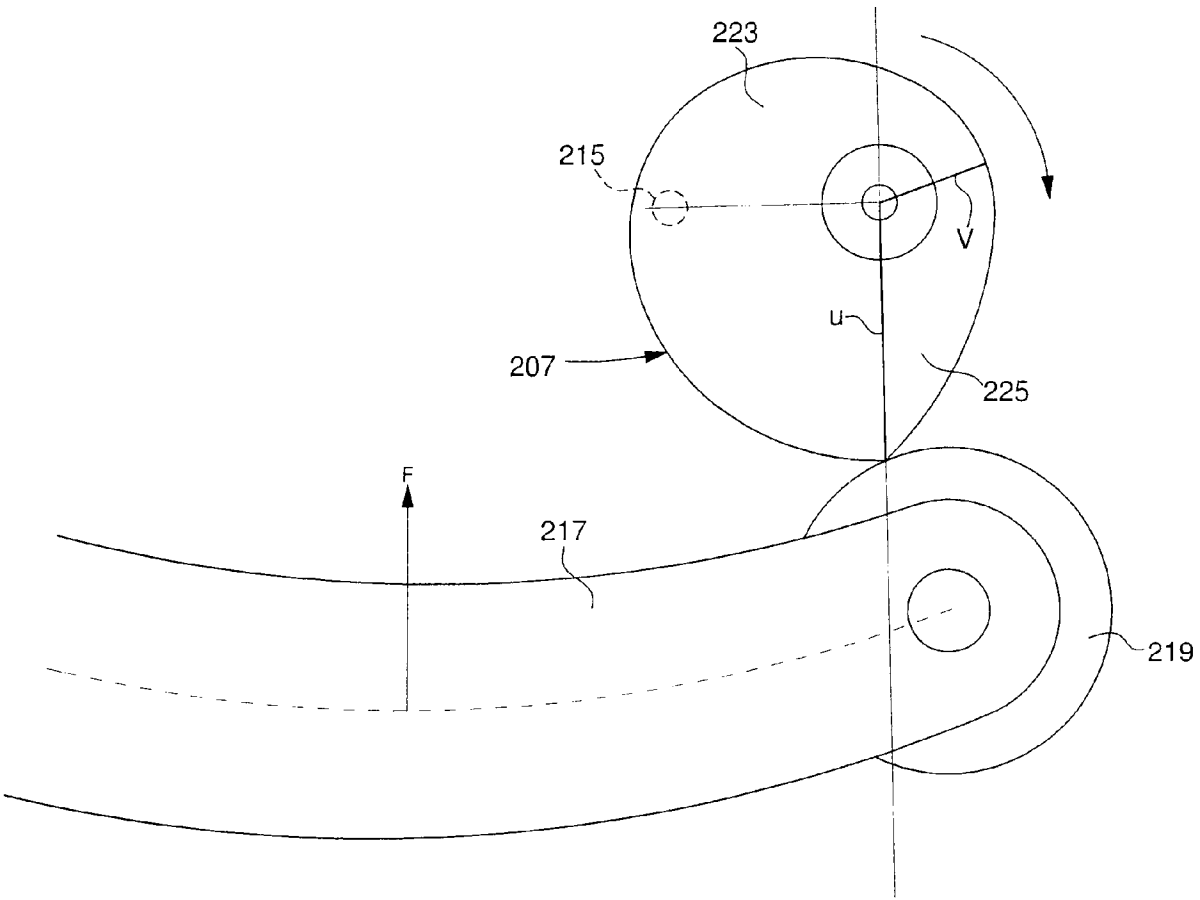
FIG. 7 is a schematic enlarged view of the cam of the actuating device of FIGS. 3 to 6 in its configuration at the instant preceding the jump.

It can be seen in FIG. 7 that the shape of the cam 207 is doubly asymmetric. In fact, the distance separating its periphery from its centre of rotation is not constant, while it can also be seen that the highest point of the curve (i.e. the point furthest away from the centre of rotation) is not located opposite the point of origin of the curve (i.e. the point closest to the centre of rotation). The radius ending at the highest point of the curve (given reference u) and the radius ending at the point of origin of the curve (given reference v) thus divide the area enclosed by the curve into two unequal sectors. The largest of these sectors will be referred to hereafter as the sector of slight inclination 223 and the smallest will be referred to as the sector of steep inclination 225. With reference once again to FIGS. 3, 5 and 6, it can be seen that the plate of the 3-hour wheel 205 has an oblong slot 206 passing through it that defines an arc of a circle and that the cam 207 bears a pin 215 arranged to slide in this oblong slot. The presence of the oblong slot allows the cam to pivot relative to the 3-hour wheel inside a sector with an extent limited by the two ends of the oblong slot.

Figure 5:
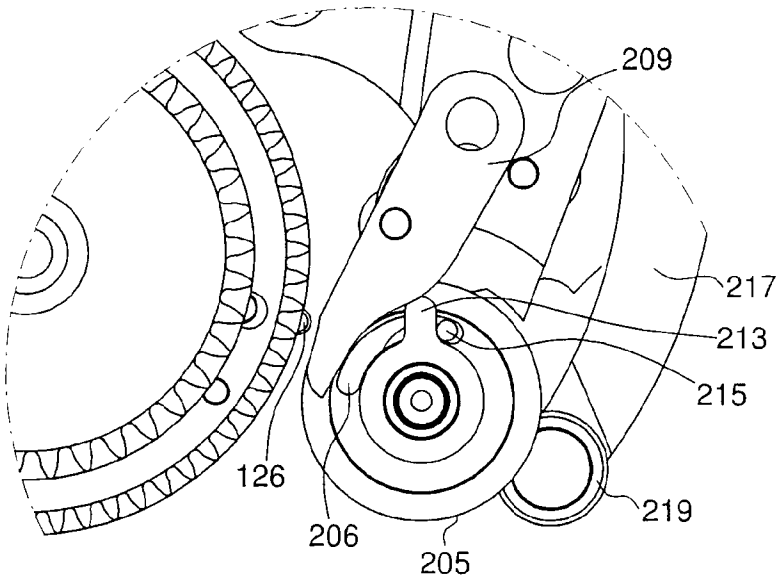
FIG. 5 is an enlarged partial plan view showing the actuating device of FIGS. 3 and 4 in its configuration at the instant preceding the jump.

In FIG. 5 the pin 215 is shown resting against an end of the oblong slot 206. In this arrangement the 3-hour wheel 205 rotatably drives the cam 207 by means of the pin. The rotation of the cam, however, forces the small roller 219 to roll along the periphery thereof. Moreover, the direction of rotation of the 3-hour wheel is such that the small roller rises along the curve moving away from the centre of rotation when it crosses the sector of slight inclination 223 and, returned by the spring (not shown), drops in the direction of the centre of rotation when it crosses the sector of steep inclination 225. When the small roller and the lever 217 thus cross the sector of steep inclination, the force exerted by the spring on the inclined periphery of the cam 207 causes the cam to be driven in the same direction as the moving force of the wheel train. Since the cam is free to pivot relative to the 3-hour wheel, the small roller 219 rapidly moves down the slope of the highest point to the point of origin of the curve causing a sudden pivoting movement of the cam and the pin 215 in the running direction. The small roller stops falling when it comes to rest at the point of origin of the curve (in the position shown in FIG. 6).

The length of the pin 215 is such that its end extends out through the oblong slot 206 so that it can push the finger 213. In FIG. 5 the finger 213 is shown resting against the pin. In this arrangement the cam 207 rotatably drives the finger 213 by means of the pin. Once each turn of the 3-hour wheel 205 the finger encounters the tipper 209 and lifts this. The actuating device is arranged so that the finger encounters the tipper approximately at the instant the small roller 219 starts to move down the inclined periphery of the cam. Thus, when pushed by the lever 217, the finger pivots vigorously, lifting the tipper 209 and sliding rapidly against its concave face of the tipper until the finger has gone past the maximum lifting point of the tipper (as shown in FIG. 6). The spring will preferably be arranged to exert as strong a pressure as possible so that the pivoting movement of the cam and the finger is very rapid.

As can be seen once again in the figures, when the tipper 209 is lifted by the finger 213, the back of the tipper is pressed against the end 126 of the small control lever 124 with sufficient force to cause the jaws of the locking clamp 121 to part and to release the pipe 113. In order to part the jaws of the locking clamp, the tipper must flex the double spring 120, and it is understood that, in reaction, the tipper is then itself pressed against the finger 213 by the double spring 120. This reaction force is without effect so long as the finger is pushed by the pin 215 and the maximum lifting point of the tipper has not been reached. Conversely, as soon as the finger goes past the maximum lifting point of the tipper (FIG. 6), the tangential component of the reaction force exerted by the tipper on the finger is directed in the direction of rotation. Since the finger is then free to turn relative to the cam and the 3-hour wheel, the tipper drops again ejecting the finger. The pressure of the tipper on the control lever is thus interrupted suddenly allowing the locking clamp to bring the pipe to a standstill at a very precise instant.

A person skilled in the art will appreciate that the actuating device that has just been described is a so-called "instantaneous" type of device. In fact, the duration of the period, during which the actuating means press against the lever 124 is not determined by the rotation speed of the trailing wheel, but by a double trigger effect caused firstly by the strong restoring spring of the lever 217 and then by the double spring 120. However, as explained above, the actuating device also determines the moment at which the locking means release the pipe 113 and the moment at which they lock it once again. Since the revolutions of the trailing wheel 205 take exactly 3 hours, the position of the minute hand for civil time at the instant the locking means are actuated is always the same. The running equation of time device is preferably arranged so that the minute hand for civil time occupies the "12 o'clock" position at the instant the locking means lock the pipe once again after having left it free for some moments. It should be noted that the choice of the "12 o'clock" position or any other particular given position does not indicate any kind of technical difficulty since on assembly the two minute hands and the heart-piece 119 can be pushed into any angular position whatsoever on their axis (references 113 and 126).

It will be additionally understood that various modifications and/or improvements obvious to a person skilled in the art can be applied to the embodiment concerned in the present description without parting from the framework of the present invention defined by the attached claims. In particular, the actuating device does not have to be instantaneous, but could be a trailing type of device. In this case, a finger 213 could, for example, turn jointly with the trailing wheel 205. The length of the finger would be determined so that the trajectory of the finger intersects that of the first end 126 of the actuating lever 124 once every turn. The shape of the end of the finger and the end of the lever 124 would then be advantageously designed so that after having come back into contact, the finger and the lever separate all at once without transition.

What is claimed is:

1. A movement for a complication timepiece provided to rotatably drive an hour hand and a minute hand for civil time and comprising a running equation of time device having a pipe mounted to rotate concentrically to the minute and hour hands for civil time and provided to support a minute hand for solar time, wherein the equation of time device comprises an equation of time cam rotatably driven by the movement at a rate of one revolution per year, and a correction mechanism provided to periodically adjust the angular displacement of the minute hand for solar time in relation to the minute hand for civil time as a function of the angular position of the equation of time cam, wherein the correction mechanism comprises:

locking means comprising a control lever and provided to interlock said pipe and the minute hand for civil time, wherein said locking means are arranged to release said pipe when a force is applied to said control lever and to lock said pipe again when said force ceases to be applied;

an actuating device driven by the movement and provided to periodically apply a force to said control lever at a regular interval corresponding to an integer number of hours;

wherein the correction mechanism additionally comprises:

a heart-piece secured to said pipe and an equation of time lever provided to cooperate with the heart-piece;

a kinematic chain linking the profile of the equation of time cam to a frame pivoted concentrically to the axes of the hands, wherein the equation of time lever is mounted to pivot on the frame in decentralised position and a spring is also arranged on the frame in order to return a free end of the equation of time lever against the heart-piece.

2. The movement for a timepiece according to claim 1, wherein the locking means comprise a locking clamp secured to the minute hand for civil time, wherein the locking clamp is associated, on the one hand, with a spring arranged to cause the clamp to close around said pipe to secure said pipe to the minute hand for civil time and associated, on the other hand, with said control lever, wherein the control lever is arranged to cause the clamp to open when a force is applied to the control lever.

3. The movement for a timepiece according to claim 1, wherein said kinematic chain between the equation of time cam and the frame comprises a rack, the stem of which is arranged to cooperate with the profile of said cam, and a gear train connecting the toothed sector of the rack to an integral toothing of the frame, wherein said toothing is concentric to the axis of the hands.

4. The movement for a timepiece according to claim 1, wherein at its end the equation of time lever comprises a roller returned against the heart-piece and arranged to roll against the profile of the heart-piece.

5. The movement for a timepiece according to claim 1, wherein said actuating device is actuated by a trailing wheel driven by the movement at the rate of one revolution every N hours, wherein N is a positive integer number.

6. The movement for a timepiece according to claim 5, wherein said actuating device comprises a finger driven by the trailing wheel and provided to actuate said control lever.

7. The movement for a timepiece according to claim 6, wherein said actuating device comprises a cam driven by the trailing wheel by means of a pin arranged to slide in an oblong slot, and a small roller returned by a spring against the periphery of the cam, and wherein the trailing wheel drives the finger by means of the cam.

8. The movement for a timepiece according to claim 6, wherein the finger actuates the control lever by means of a tipper.

9. The movement for a timepiece according to claim 5, wherein the trailing wheel is driven by the motion-work of the movement at the rate of one revolution every 3 hours.

* * * * *